United States Patent [19]

Stephanoff

[11] 3,958,342

[45] May 25, 1976

[54] NON-CLOGGING CENTRIFUGAL DRYING MILL

[75] Inventor: Nicholas N. Stephanoff, Haverford, Pa.

[73] Assignee: Fluid Energy Processing & Equipment Co., Hatfield, Pa.

[22] Filed: Mar. 20, 1975

[21] Appl. No.: 560,252

[52] U.S. Cl. ..... 34/57 E; 34/57 R

[51] Int. Cl.[2] ..... F26B 17/00

[58] Field of Search ..... 34/10, 15, 58, 59, 57 R, 34/57 A, 57 B, 57 D, 57 E

[56] References Cited

UNITED STATES PATENTS

| | | | |
|---|---|---|---|
| 2,237,091 | 4/1941 | Stephanoff | 34/57 E |
| 2,502,916 | 4/1950 | Bar | 34/57 E |
| 3,309,785 | 3/1967 | King | 34/57 R |

FOREIGN PATENTS OR APPLICATIONS

| | | | |
|---|---|---|---|
| 333,859 | 8/1930 | United Kingdom | 34/57 E |

*Primary Examiner*—Kenneth W. Sprague
*Assistant Examiner*—James C. Yeung
*Attorney, Agent, or Firm*—Arthur A. Jacobs

[57] ABSTRACT

A centrifugal drying mill for wet particles comprising an arcuate housing that includes an inlet chamber having a feed inlet and nozzles for propelling hot gaseous fluid into the inlet chamber to dry and propel the fed particles in a centrifugal path through the housing, there being means to concentrate dry particles of varying sizes in the inner portion of the centrifugal path from which they may be centrifugally exhausted from the mill, such means comprising either a baffle plate in opposed relationship to the exhaust means or a rectangular housing section at the area of the exhaust means.

5 Claims, 6 Drawing Figures

FIG.1
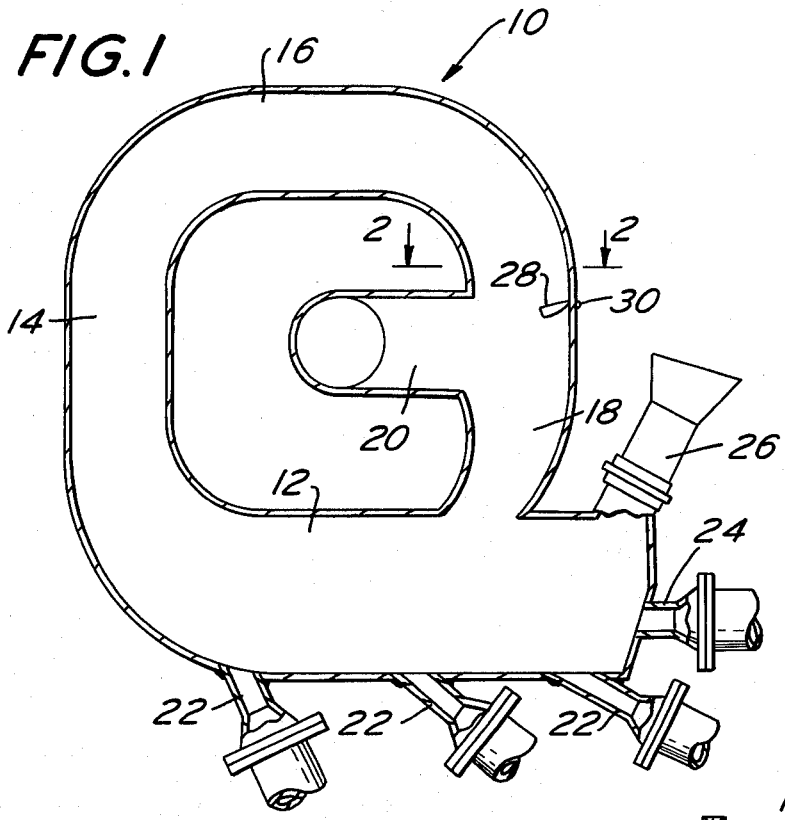
FIG.2
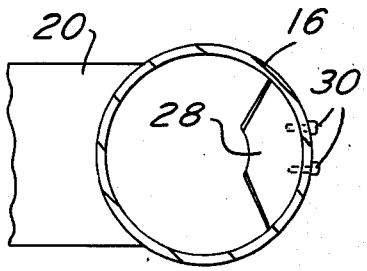
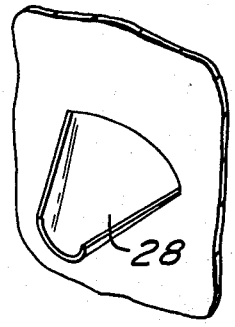
FIG.2A
FIG.3
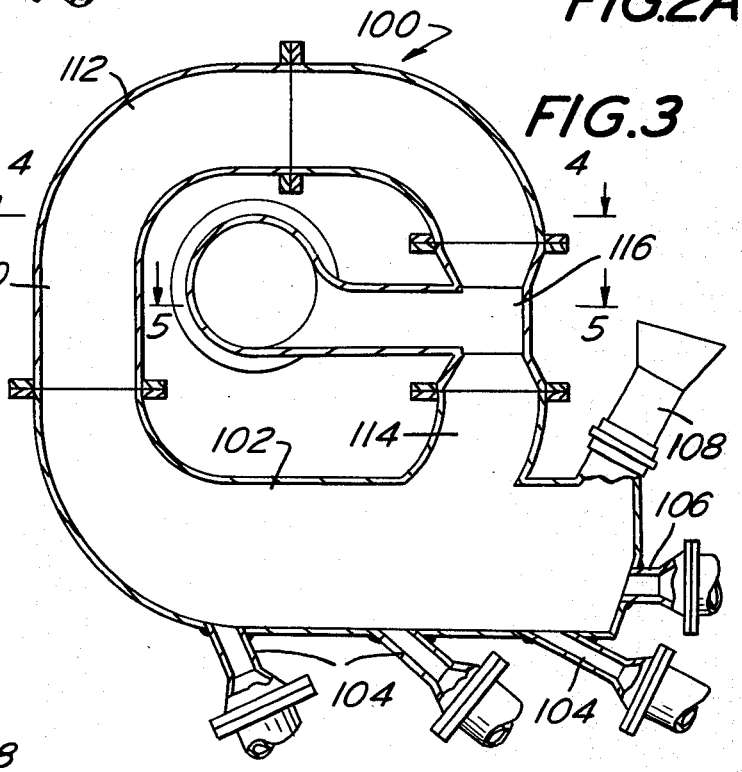
FIG.5
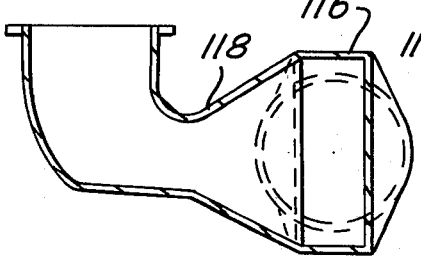
FIG.4
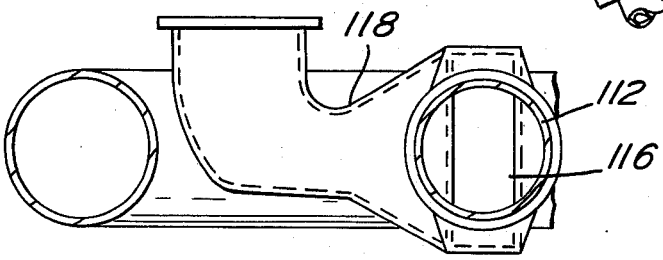

NON-CLOGGING CENTRIFUGAL DRYING MILL

This invention relates to drying mills for drying wet particles such as are present in sludge or the like, and it particularly relates to drying mills of the centrifugal type.

Drying mills of this type comprise an inlet chamber which is adapted to receive wet particles, such as a slurry or the like, and which is provided with a series of angular gaseous fluid inlet nozzles connected to a source of hot gaseous fluid. The wet particles are fed into one end of the inlet chamber, in the form of a solid wet feed, and are entrained in the gaseous fluid. The opposite end of the inlet chamber is connected to an upstack which is itself connected to a classification section. The classification section is connected to a downstack which leads into the inlet chamber adjacent the particle feed inlet. Between the classification section and the downstack, on the inner periphery, is an exhaust port. The upstack, classification section and downstack form a generally arcuate path.

As the particles are entrained in the hot angularly-directed gases, they are whirled in a centrifugal action through a generally arcuate path leading from the upstack to the classification section, at which time a large proportion of the particles are completely dried while some are only partially dried. The completely dried particles, being lighter, whirl around in the inner portion of the centrifugal path while the less dry particles, being heavier, whirl around in the outer portion of the centrifugal path. Such separation or classification is effected primarily in the classification section, so that as the particles descend into the downstack, the lighter particles in the inner centrifugal portion pass through the exhaust port while the heavier particles pass down through the downstack into the inlet chamber where they mix with fresh feed and are again entrained by the hot gaseous fluid and recycled through the mill.

Although mills of the above type are generally quite satisfactory for atomized slurries and the like, problems arise when sludge is being processed because sludge, in the form of wet solids, is a conglomerate of both large and small particles. It is desirable that both the smaller and larger particles, once they are passed through the drying path, be exhausted rapidly from the mill, but, instead, the larger, heavier particles continue to recycle through the mill in the outer portion of the centrifugal path, and eventually cause clogging.

It is one object of the present invention to overcome the aforesaid difficulties by providing a centrifugal type drying mill where relatively large, dry particles are effectively exhausted from the mill before they are recycled back through the inlet chamber.

Another object of the present invention is to provide a drying mill of the aforesaid type that is relatively simple in operation and easy and inexpensive to construct and maintain.

Other objects and many of the attendant advantages of this invention will be readily appreciated as the same becomes better understood by reference to the following description when read in conjunction with the accompanying drawings wherein:

FIG. 1 is a sectional view of a mill embodying the present invention.

FIG. 2 is a sectional view taken on line 2—2 of FIG. 1.

FIG. 2A is a perspective view of the baffle plate shown in FIG. 2.

FIG. 3 is a sectional view of an alternative embodiment of the invention.

FIG. 4 is a sectional view taken on line 4—4 of FIG. 3.

FIG. 5 is a sectional view taken on line 5—5 of FIG. 3.

Referring now in greater detail to the figures of the drawings wherein similar reference characters refer to similar parts, there is shown in FIG. 1 a centrifugal drying mill, generally designated 10, comprising an inlet or drying chamber 12, an upstack 14, a classification section 16, a downstack 18, and an exhaust duct 20 leading from the inner periphery of the mill, between the classification section and the downstack, to a collection device (not shown).

Leading into the inlet chamber 12, in the ordinary manner, are a plurality of tangential gaseous fluid nozzles 22 connected to a manifold or other source of hot gaseous fluid under pressure (not shown), an axial gaseous fluid nozzle 24, connected to the same or another source of hot gaseous fluid, and a feed inlet 26, of any desirable type, for feeding the sludge or other material to be dried.

In the ordinary operation, since the larger particles are whirled around in the outer peripheral portion of the centrifugal path, and since it is the weight rather than the degree of dryness which determines such course, the relatively heavy particles of sludge, even when sufficiently dry, would not pass through the exhaust duct 20 but would pass through the downstack to the inlet chamber. However, in the present mill, this is prevented by a baffle plate or tongue 28 extending from the inner surface of the outer wall of the mill, because as the dry particles in the outer portion of the centrifugal path pass down from the classification section, they are deflected by the plate 28 toward the exhaust opening. On the other hand, the large particles which are not sufficiently dry, being even heavier than those that are dry, continue to fall into the downstack, between the plate 28 and the entrance to the exhaust duct 20, so that they can be recycled for further drying. The plate 28 is preferably releasably connected to the mill wall by any feasible means so that it can be easily replaced when worn or so that various sizes may be used as necessary. This construction also permits the selective use of plates of different angles so that the angles at which the particles strike the plate and are deflected therefrom may be varied in accordance with the type of material being processed.

Any feasible adjustable or replaceable construction may be used. The preferable construction is that shown wherein bolts or screws 30 extend through an aperture in the mill wall to threadedly engage threaded openings in the rear wall of the baffle plate 28.

The plate 28, itself, is preferably of a concave, scoop-like construction, as best shown in FIG. 2A.

In FIGS. 3, 4, and 5 there is shown an alternative form of the invention wherein a mill, generally designated 100, comprises an inlet or drying chamber 102 having gaseous inlet nozzles 104, an end nozzle 106 and a feed inlet 108. The mill also comprises an upstack 110, a classification section 112 and a downstack 114, all of tubular construction with a round cross-section. However, between the classification section 112 and the downstack 114 is provided an intermediate section 116 which has a central portion of rectangular cross-section (as best seen in FIGS. 4 and 5). Extending from the inner wall of the intermediate section 116 is an exhaust duct 118.

The rectangular shape of the intermediate section 116, at the area of the exhaust duct, acts to squeeze the outer periphery of the centrifugal path toward the inner periphery so that even the heavier particles are in the inner portion of the centrifugal path at the area where exhaustion from the mill takes place. Therefore, although the heaviest, and, therefore, least dry, particles will still have sufficient weight to fall into the downstack, those particles of intermediate weight, which are sufficiently dry but which would ordinarily have been in the outer portion of the centrifugal path, are exhausted from the mill along with the lighter particles.

Although the downstack 114 is shown as being tubular in construction, this being preferable, it is also within the scope of the invention to make it rectangular as a continuation of the section 116.

The invention claimed is:

1. A centrifugal drying mill for wet particles comprising a generally arcuate housing including, in progression, an inlet chamber, an upstack, a classification section, and a downstack, said downstack leading into said inlet chamber, an exhaust duct leading from the inner periphery of said housing between said classification section and said downstack, a feed inlet connected to said inlet section to deliver wet particulate material thereto, a plurality of gaseous fluid nozzles constructed and arranged to propel hot gaseous fluid from a source thereof into said inlet chamber in such a manner as to entrain the particulate material, apply drying heat thereto, and propel the particles thereof in a centrifugal path through said housing, and means between said classification chamber and said downstack to prevent centrifugal separation of lighter from heavier particles and to concentrate dry particles of varying weights in the inner peripheral portion of said centrifugal path adjacent said exhaust duct to permit passage of the concentrated dry particles through said exhaust duct.

2. The mill of claim 1 wherein said means comprises a baffle plate projecting from the inner surface of the outer housing wall in opposed relationship to said exhaust duct.

3. The mill of claim 2 wherein said baffle plate is selectively angularly adjustable.

4. The mill of claim 2 wherein said baffle plate is releasably secured to said outer housing wall.

5. The mill of claim 1 wherein said means comprises a rectangular intermediate section between said classification section and said downstack, said intermediate section comprising part of said housing.

* * * * *